US006222368B1

(12) United States Patent
Inagaki et al.

(10) Patent No.: US 6,222,368 B1
(45) Date of Patent: Apr. 24, 2001

(54) ION CURRENT DETECTION APPARATUS

(75) Inventors: Hiroshi Inagaki; Noriaki Kondo; Shigeru Miyata, all of Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/238,574

(22) Filed: Jan. 28, 1999

(30) Foreign Application Priority Data

Jan. 28, 1998 (JP) ..... 10-016030
Dec. 28, 1998 (JP) ..... 10-374116

(51) Int. Cl.[7] ..... F02P 17/00
(52) U.S. Cl. ..... 324/399
(58) Field of Search ..... 324/399, 382, 324/391, 398, 546

(56) References Cited

U.S. PATENT DOCUMENTS 5,271,268 12/1993 Ikeuchi et al. ..... 73/115
5,345,181 * 9/1994 Mantani et al. ..... 324/546
5,861,551 * 1/1999 Morita et al. ..... 324/399

FOREIGN PATENT DOCUMENTS 8-338298 12/1996 (JP) ..... F02D/45/00

* cited by examiner

*Primary Examiner*—Safet Metjahic
*Assistant Examiner*—J Kerveros
(74) *Attorney, Agent, or Firm*—Sughrue, Mion, Zinn, Macpeak & Seas, PLLC

(57) ABSTRACT

An ion current detection apparatus which can detect ion current with a high degree of accuracy regardless of the presence of voltage damped oscillation and which does not cause contamination of a spark plug. A spark discharge current Isp generated upon spark discharge of a spark plug 10 flows through a charge diode 28, a capacitor 24, and a diode 22, which form a closed loop together with the spark plug 10 and a secondary winding L2 of an ignition coil 12 that constitutes an ignition apparatus. As a result, a Zener diode 26 connected in parallel to these components generates a Zener voltage Vz and thereby charges the capacitor 24. When a preset wait time has elapsed after the ignition timing for starting spark discharge, the discharge switch 30 short-circuits the opposite ends of the charge diode 28 to discharge the capacitor 24, so that a high voltage having a polarity opposite that in the case of spark discharge is applied to the spark plug. An ion current Iio flowing at this time is detected by use of a resistor 22 connected in parallel to the diode 22.

5 Claims, 7 Drawing Sheets

ION CURRENT DETECTION APPARATUS

FIELD OF THE INVENTION

The present invention relates to an ion current detection apparatus for detecting ion current that flows after spark discharge of a spark plug.

Conventionally, in order to detect misfire or knocking of an internal combustion engine, as well as various other operation conditions of the internal combustion engine (e.g., such as air-fuel ratio, lean limit of air-fuel ratio, limit in amount of recirculated exhaust gas), there has been utilized a technique for detecting the ion current which flows due to ions present in the vicinity of electrodes of a spark plug of the engine after spark discharge.

That is to say, within a cylinder of an internal combustion engine, ions are generated when combustion (flame propagation) occurs after spark discharge of a spark plug, and the resistance between the electrodes of the spark plug changes in accordance with the number of ions generated, which in turn changes depending on the combustion state or the operation state of the engine. Therefore, changes in the resistance between electrodes of the spark plug (i.e., the changes in operation state) can be detected by a method in which, after application of high voltage for ignition purpose (i.e., after spark discharge of the spark plug), a voltage is externally applied to the spark plug in order to cause a flow of ion current, which is then detected.

BACKGROUND OF THE INVENTION

An example of such an ion current detection apparatus disclosed in Japanese Patent Application Laid-Open No. 4-191465 will be described.

As shown in FIG. 6 of the accompanying drawings, an ignition apparatus 2 to which is applied an ion current detection apparatus 100 includes a spark plug 10 provided for each cylinder (only one cylinder is represented in FIG. 6) of an internal combustion engine, as well as an ignition coil 12 for applying the spark plug 10 with high voltage for ignition purpose.

A battery voltage Vb is applied to one end of a primary winding L1 of the ignition coil 12, while the other end of the primary winding L1 is grounded via a power transistor 14, which is turned on and off in accordance with an ignition signal IG. One end of a secondary winding L2 of the ignition coil 12 is connected to a center electrode of the spark plug 10, and the other end of the secondary winding L2 is connected to the ion current detection apparatus 100. An outer electrode of the spark plug 10 is grounded.

In the ignition apparatus 2, when the ignition signal IG is at a high level, the power transistor 14 is turned on, so that a current flows through the primary winding L1 of the ignition coil 12. When the ignition signal IG subsequently reaches a low level and the power transistor 14 is turned off, a high ignition voltage is generated across the secondary winding L2 of the ignition coil 12. This high voltage is applied to the center electrode of the spark plug 10 in order to cause the spark plug 10 to effect spark discharge. The ignition apparatus 2 is designed such that the center electrode of the spark plug 10 attains negative polarity during the spark discharge; therefore, the spark discharge current Isp caused by the spark discharge flows from the spark plug 10 to the secondary winding L2.

The ion current detection apparatus 100 includes a resistor 20, one end of which is grounded; a diode 22 which is connected in parallel to the resistor 20 and whose cathode is grounded; a capacitor 24 connected in series to the ungrounded end of the resistor 20 and to the ungrounded end of the diode 22; and a Zener diode 26 which is connected in parallel to the circuit comprising the resistor 20, the diode 22, and the capacitor 24. The cathode of the Zener diode 26 is connected to the capacitor 24, and the anode of the Zener diode 26 is grounded. The connection line between the capacitor 24 and the Zener diode 26 is connected to the secondary winding L2 of the ignition coil 12. A voltage generated across the resistor 20 is output as a detection value Vio.

In the ion current detection apparatus 100 having the above-described structure, the spark discharge current Isp stemming from spark discharge of the spark plug 10 flows through a current path including the capacitor 24 and the diode 22, while causing the Zener diode 26 to produce a Zener voltage Vz. Therefore, due to the spark discharge current Isp, the capacitor 24 is charged by a voltage Vc (=Vz−Vf) which is smaller than the Zener voltage Vz of the Zener diode 26 by the forward voltage Vf of the diode 22.

When the high ignition voltage induced in the secondary winding L2 drops to a level lower than the Zener voltage Vz, the capacitor 24 starts discharging, so that a high detection voltage according to the charged voltage Vc is applied to the spark plug 10 via the secondary winding L2 of the ignition coil 12. As a result, an ion current Iio flows in accordance with the number of ions generated between the electrodes of the spark plug 10. Since the ion current Iio flows through the resistor 20, the ion current detection apparatus 100 outputs a detection value Vio corresponding to the ion current Iio.

However, in the secondary-side circuit of the ignition apparatus 2, since the inductance of the secondary winding L2 of the ignition coil 12 and the capacitance between the electrodes of the spark plug 10 form a resonant circuit, voltage damped oscillation is generated after completion of spark discharge of the spark plug.

Depending on the operation conditions of the internal combustion engine, the magnitude of the current that flows during that period may reach a value of several to several tens of times the ion current Iio. In addition, the oscillation continues for a relatively long period of time as long as several milliseconds. Therefore, as shown in FIG. 7, the oscillation component is superposed on the ion current Iio, resulting in it being impossible to measure properly the ion current Iio.

In order to overcome the above-described problem, the measurement may be performed at a point in time when the voltage damped oscillation has converged. However, since the charge accumulated in the capacitor 24 is consumed by the voltage damped oscillation, when the voltage damped oscillation converges, a high voltage required for detection of the ion current Iio becomes impossible to obtain, resulting in possible failure to detect the ion current Iio.

This problem can be mitigated through an increase in the capacitance of the capacitor 24, which allows a larger amount of charge to be accumulated during spark discharge of the spark plug 10. However, in this case, if only a small amount of charge is consumed due to flow of the ion current Iio, an undesirable voltage is applied to the spark plug 10 due to the charge remaining in the capacitor 24. In this case, if particles of deposited carbon and liquid fuel are present on the surface of the insulator of the spark plug 10, particles are easily moved and aligned between the electrodes by an electric field that is produced through the voltage application. As a result, there arises a new problem that so-called contamination of the spark plug 10, in which the insulating resistance between the electrodes of the spark plug decreases, occurs quickly.

SUMMARY OF THE INVENTION

In view of the forgoing problems, an object of the present invention is to provide an ion current detection apparatus which can detect ion current with a high degree of accuracy regardless of the presence of voltage damped oscillation and which does not cause contamination of a spark plug.

In order to achieve the above object, an ion current detection apparatus according to a first aspect of the invention includes: a capacitor which forms a closed loop together with a spark plug and a secondary winding of an ignition coil; current detection means for detecting current flowing through the closed loop; and charge means for charging the capacitor to a predetermined high voltage for detection, through use of spark discharge current flowing during spark discharge of the spark plug. A high ignition voltage which is generated in the secondary winding through intermittent supply of primary current to a primary winding of the ignition coil is applied to the spark plug attached to a cylinder of an internal combustion engine in order to cause spark discharge. Subsequently, the capacitor charged by the charge means applies to the secondary winding of the ignition coil and the spark plug a high voltage for detection having a polarity opposite that of the high voltage for ignition. An ion current flowing through the closed loop at this time is detected by the current detection means. The ion current detection apparatus of this aspect further comprises a charge diode, a discharge switch, and switching control means. The charge diode is connected in series to the capacitor such that the forward direction of the charge diode coincides with the flow direction of the spark discharge current and is adapted to prevent discharge of charge accumulated in the capacitor by the charge means. The discharge switch short-circuits opposite ends of the charge diode in order to discharge charge accumulated in the capacitor. The switching control means operates the discharge switch at a timing at which the ion current is to be detected.

Thus in the ion current detection apparatus having the above-described structure, at the time of spark discharge, through utilization of the spark discharge current, the charge means charges the capacitor to a predetermined high voltage for detection. Since the spark discharge current is supplied to the capacitor via the charge diode, the charge is not discharged even when the high voltage for ignition becomes lower than the charged voltage of the capacitor (high voltage for detection). That is, even when the high voltage for ignition causes oscillation, the oscillation does not cause leaking out of the charge accumulated in the capacitor.

Subsequently, at the timing when ion current is to be detected, the switching control means operates the discharge switch in order to short-circuit opposite ends of the charge diode. Thus, a high voltage for detection having a polarity opposite that of the high voltage for ignition is applied to the secondary winding of the ignition coil and the spark plug. As a result, an ion current flows in a closed loop formed by the ignition coil, the spark plug, the capacitor, and a current detection resistor in an amount corresponding to the resistance between the electrodes of the spark plug. The ion current can be detected by the current detection means.

That is, in the ion current detection apparatus of the present invention, charge accumulated in the capacitor is discharged, at only the timing when the ion current is to be detected, to thereby apply to the spark plug a high voltage for detection.

Accordingly, in the ion current detection apparatus of the present invention, even when voltage damped oscillation occurs in the secondary-side circuit of the ignition coil after spark discharge, charge accumulated in the capacitor is not wastefully consumed thereby, so that the capacitance of the capacitor can be set to a necessary and sufficient value. In addition, reliable detection of the ion current is possible.

Further, the ion current detection can be performed after the voltage damped oscillation has converged to some degree, while the period in which the damped oscillation is large is avoided. Therefore, the ion current detection can be performed with a high degree of accuracy. As a result, the value detected by the ion current detection apparatus of the present invention corresponds substantially to the ion current only, so that a filter or the like for removing noise components from the detection value can be omitted or simplified.

Further, even when only a small amount of ion current flows after spark discharge due to misfire of the engine or other cause, and charge remains at the capacitor, the voltage of the capacitor is not applied to the spark plug when the discharge switch is opened. Therefore, contamination of the spark plug can be prevented.

The ion current detection apparatus may be further characterized in that the timing at which the switching control means operates the discharge switch is set in accordance with the operation conditions of the engine. Since the operation timing of the discharge switch; i.e., the detection timing of the ion current, can be set in accordance with operation conditions, such as the rotation speed of the engine, that affect the timing of generation of the ion current, more accurate and stable detection can be performed.

The ion current detection apparatus of the above first aspect may be further characterized by provision of grounding means for grounding a current path extending from the anode of the charge capacitor to the spark plug during an arbitrary period after the discharge switch is opened but before the next spark discharge is caused. Since charge remaining at the electrode of the spark plug can be reliably removed by the grounding means, contamination of the spark plug can be prevented in a more reliable manner.

By the way, the detection of ion current can be properly performed through use of a conventional apparatus as is without provision of the charge diode, the discharge switch, and the switching control means described above, if the damped oscillation appearing after spark discharge is reduced through proper adjustment of the inductance and stray capacitance of the secondary winding of the ignition coil. However, even in such a case, if a sufficient amount of ion current does not flow due to misfire or the like and thus charge remains in the capacitor, undesirable voltage is applied to the electrode of the spark plug, resulting in contamination of the spark plug.

In a second aspect of the invention an ion current detection apparatus includes: a capacitor which forms a closed loop together with a spark plug and a secondary winding of an ignition coil; current detection means for detecting current flowing through the closed loop; and charge means for charging the capacitor to a predetermined high voltage for detection, through use of spark discharge current flowing during spark discharge of the spark plug. A high voltage for ignition which is generated in the secondary winding through intermittent supply of primary current to a primary winding of the ignition coi is applied to the spark plug attached to a cylinder of an internal combustion engine in order to cause spark discharge. Subsequently, the capacitor charged by the charge means applies to the second winding of the ignition coil and the spark plug a high voltage for detection having a polarity opposite that of the high voltage for ignition. An ion current flowing through the closed loop at this time is detected by the current detection means. The ion current detection apparatus of this aspect further comprises grounding means for grounding a high voltage side of the capacitor charged by the charge means, during an arbitrary period between detection of the ion current by the current detection means and subsequent spark discharge.

In the ion current detection apparatus of this aspect of the present invention the charge remaining at the capacitor after spark discharge is reliably removed by the grounding means. Therefore, it is possible to prevent the phenomenon that application of undesirable voltage to the electrode of the spark plug continues until subsequent spark discharge occurs, so that contamination of the spark plug can be prevented reliably.

BRIEF DESCRIPTION OF THE DRAWINGS

The invention will be further described by way of example with reference to the accompanying drawings, in which.

DESCRIPTION OF SYMBOLS USED IN THE DRAWINGS

Figure 1:
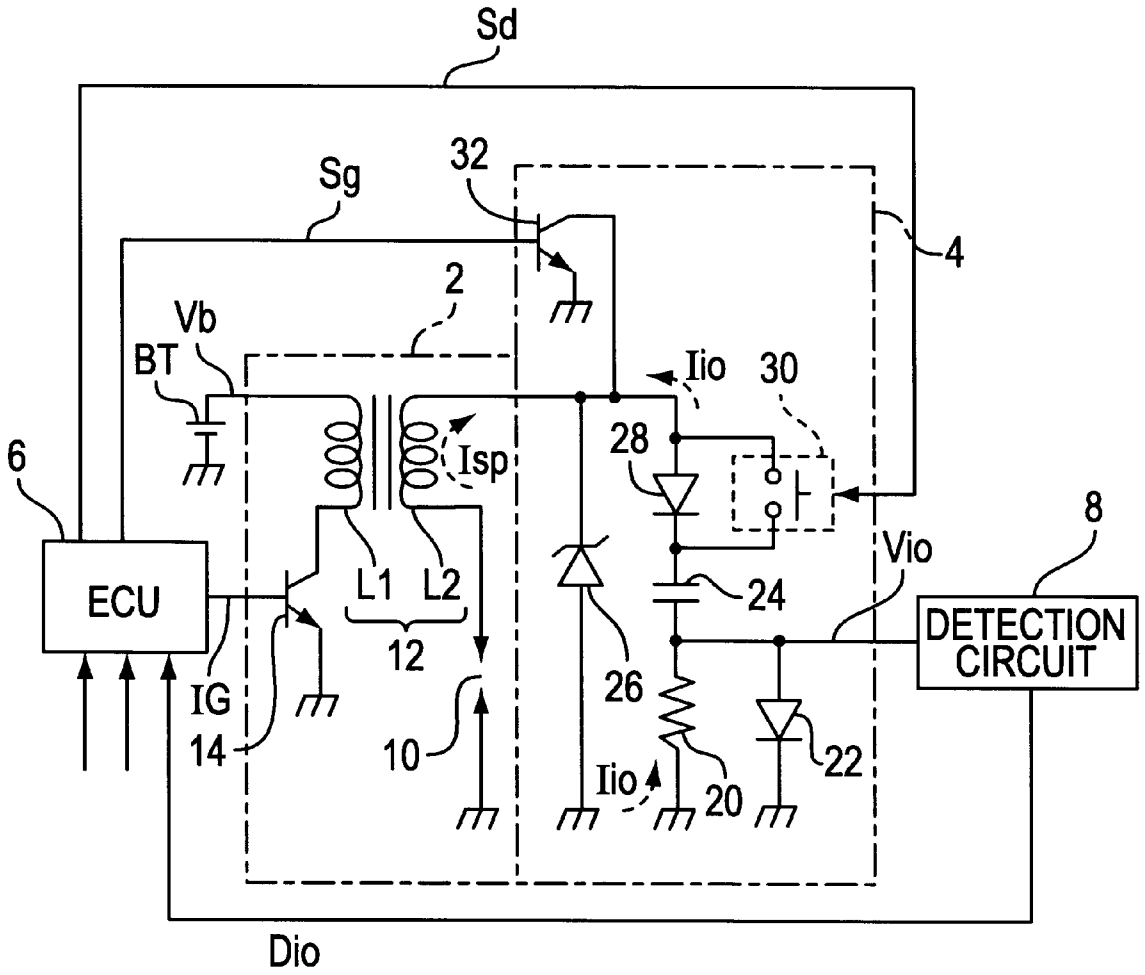
FIG. 1 is a diagram showing the overall structure of an internal combustion engine control system to which an ion current detection apparatus of a first embodiment is applied.

2 . . . ignition apparatus
4 . . . ion current detection apparatus
6 . . . ECU
8 . . . detection circuit
10 . . . spark plug
12 . . . ignition coil
14 . . . power transistor
20 . . . resistor
22 . . . diode
24 . . . capacitor
26 . . . Zener diode
28 . . . charge diode
30 . . . discharge switch
32 . . . transistor
L1 . . . primary winding
L2 . . . secondary winding

DESCRIPTION OF THE PREFERRED EMBODIMENTS

First Embodiment

FIG. 1 shows a schematic structure of an internal combustion engine control system equipped with a single-electrode distributor-less-type ignition apparatus to which the present invention is applied.

As shown in FIG. 1, the internal combustion engine control system includes an ignition apparatus 2, a battery BT, an ion current detection apparatus 4, an electronic control unit (hereinafter referred to as an "ECU") 6 for an internal combustion engine, and a detection circuit 8. In accordance with an externally input ignition signal IG, the ignition apparatus 2 causes a spark plug 10 provided for each cylinder of the internal combustion engine to discharge sparks. The battery BT supplies power to the ignition apparatus 2. At the timing of an externally input detection signal, the ion current detection apparatus 4 detects an ion current that flows due to ions generated in the vicinity of the electrodes of the spark plug 10. The ECU 6 outputs the ignition signal IG to the ignition apparatus 2 and also outputs the detection signal Sd to the ion current detection apparatus 4. The detection circuit 8 converts an analog output of the ion current detection apparatus 4 into a digital signal suitable or input to the ECU 6.

Although corresponding structural components (other than he ECU 6) are provided for each cylinder of the engine, in the interests of facilitating understanding, FIG. 1 shows only the structural components provided for one cylinder.

Figure 6:
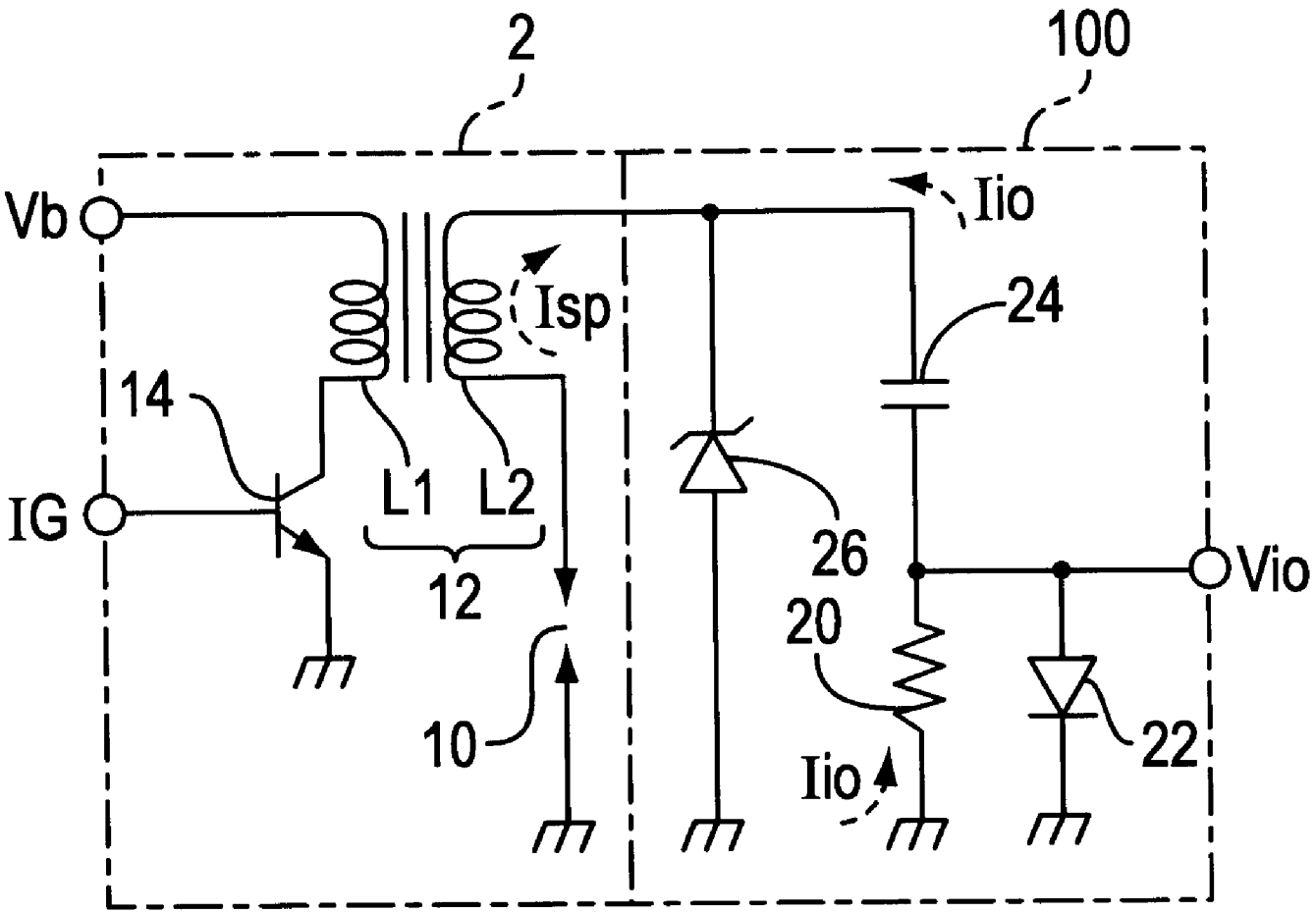
FIG. 6 is a diagram showing the overall structure of a conventional apparatus.
Figure 7:
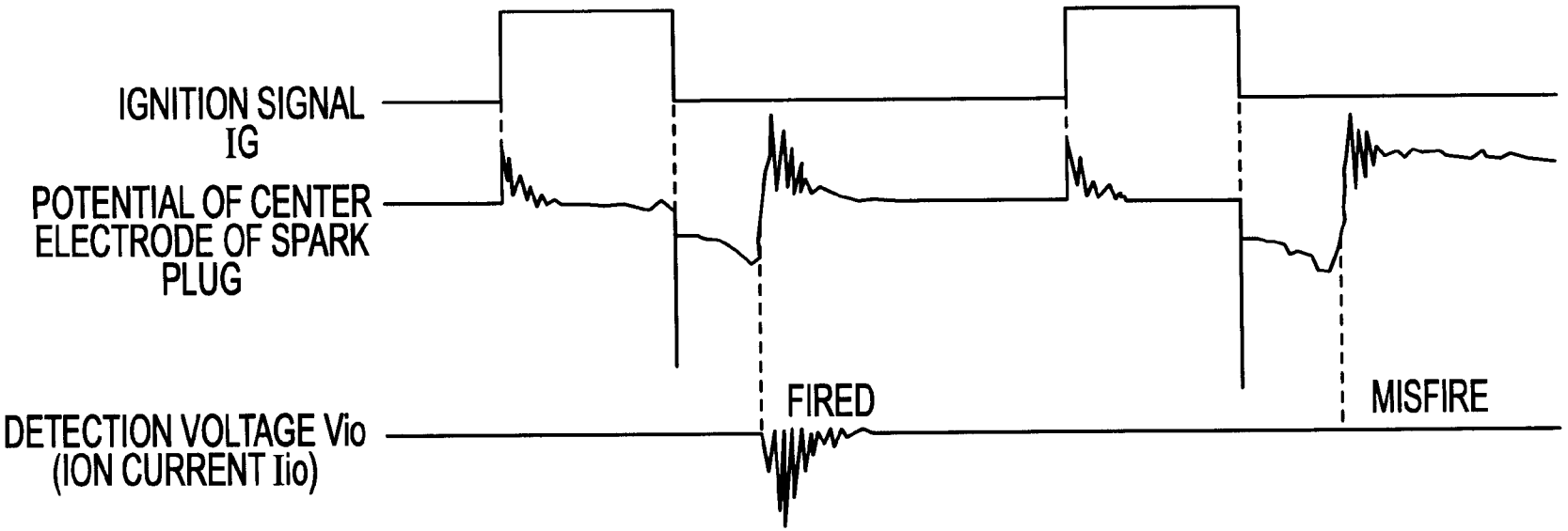
FIG. 7 is a wave chart showing signals at respective points in the conventional apparatus.

The ignition apparatus 2 has the same structure as the ignition apparatus shown in FIG. 6 and described above, whereas the ion current detection apparatus 4 has the same structure as the conventional ion current detection apparatus 100 except for some portions. Therefore, identical structural portions are denoted by the same symbols, and their descriptions will be omitted. Only those portions that differ from the conventional apparatus will be described.

In the ion current detection apparatus 4, within a closed loop formed by a capacitor 24, a resistor 20, and a diode 22 in cooperation with a secondary winding L2 of an ignition coil 12 and the spark plug 10, a charge diode 28 is connected in series between the capacitor 24 and the secondary winding L2 of the ignition coil 12, such that the forward direction of the diode 28 corresponds to the flow direction of spark discharge current Isp. Further, a discharge switch 30, which short-circuits the opposite ends of the charge diode 28 in accordance with the detection signal Sd input externally, is connected in parallel to the charge diode 28. That is, the circuit formed by the capacitor 24, the resistor 20, the diode 22, the charge diode 28, and the discharge switch 30 is connected in parallel to the Zener diode 26.

Further, a transistor 32 is provided in the ion current detection apparatus 4. The collector of the transistor 32 is connected to a line for connection with the secondary winding L2 of the ignition coil 12, whereas the emitter of the transistor 32 is grounded. The transistor 32 grounds the line connected to the secondary winding L2 in accordance with a ground signal Sg that is externally input to the base. In the present embodiment, the resistor 20 serves as a current detection means, and the Zener diode 26 serves as a charge means.

In the ion current detection apparatus 4 having the above-described structure, when the discharge switch 30 is opened, current can flow only in the direction from the line connected to the second winding L2 toward the ground. At this time, a current flows in a closed loop including the charge diode 28, the capacitor 24, and the diode 22. At the same time, a current flows through the Zener diode 26 in such a direction as to generate a Zener voltage Vz. Therefore, the capacitor 24 is charged by a voltage $Vc=(Vz-2\times Vf)$ which is smaller than the Zener voltage Vz of the Zener diode 26 by the sum of the forward voltages Vf of the charge diode 28 and the diode 22.

When the discharge switch 30 is closed and thus the opposite ends of the charge diode 28 are short-circuited, current is allowed to flow from the grounded side toward the line connected to the secondary winding L2. At this time, since a current flows in a closed loop including the resistor 20, the capacitor 24, and the discharge switch 30, the voltage produced across the resistor 20 corresponds to the magnitude of the current.

The voltage Vp applied to the spark plug 10 at this time becomes smaller than the charged voltage Vc of the capacitor 24 by the voltage drop at the resistor 20 ($Vp=Vc-R\times Iio$, where R is the resistance of the resistor 20). The applied voltage Vp must be set to a level at which the spark plug 10 does not cause spark discharge (e.g., about 1 kV); i.e., the Zener voltage Vz of the Zener diode 26 must be set on the basis of the applied voltage Vp.

When the transistor 32 is turned on in response to the ground signal Sg and thus the line connected to the secondary winding L2 is grounded, the charge remaining at the electrodes of the spark plug 10 is discharged.

Next, there will be described an ion current detection processing performed by the ECU 6.

The ECU 6 is provided for performing total control of the ignition timing, fuel injection amount, and idling speed of the internal combustion engine, and therefore performs condition detection processing for detecting various operation conditions such as an intake pipe pressure (or intake air amount), rotational speed, cooling water temperature of the engine, and signal output processing for various kinds of signals required for controlling the engine, such as the above-described ignition signal IG in accordance with the detected operation conditions, as well as ion current detection processing, which will be described below. The signal output processing sets the ignition signal IG to a high level at a predetermined time earlier than an ignition timing of each cylinder that is set in accordance with the operation conditions, and then sets the ignition signal IG to a low level at the ignition timing.

Figure 2:
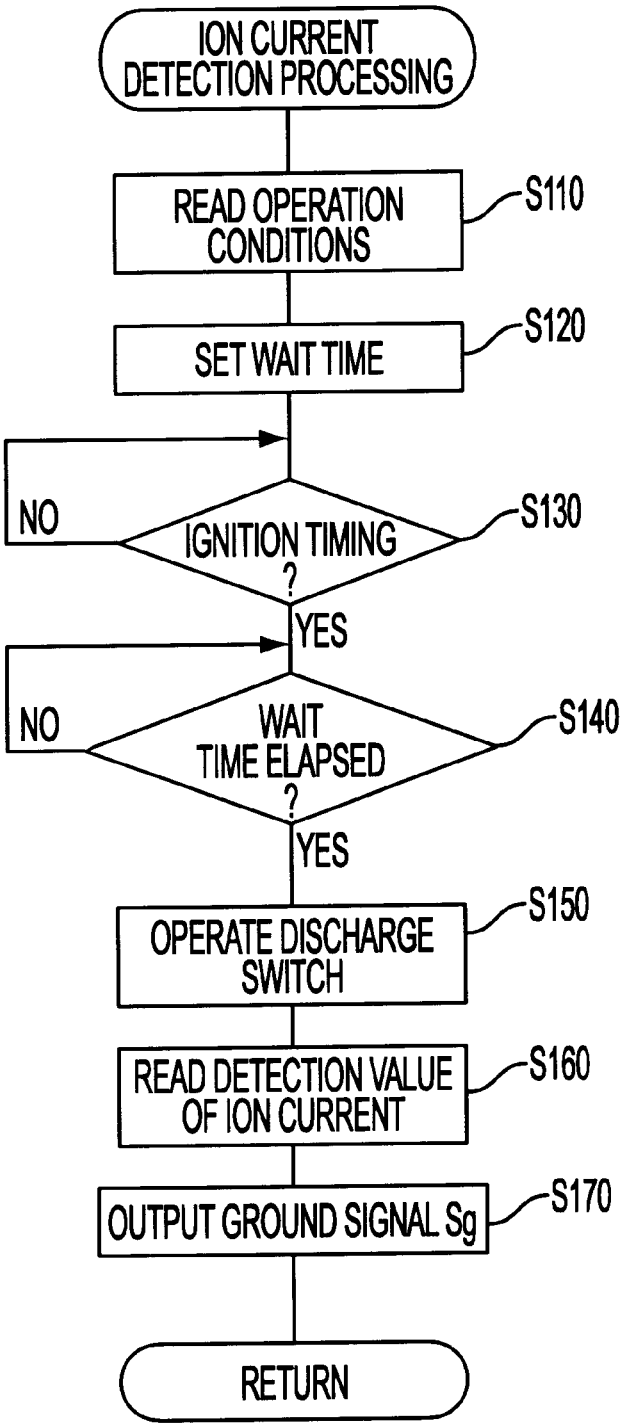
FIG. 2 is a flowchart showing ion current detection processing executed by the ECU.

As shown in FIG. 2, when the ion current detection processing is started, in step S110, the ECU 6 reads in conditions, such as the rotational speed of the engine, that affect the timing of generation of ions between the electrodes of the spark plug 10, among the operation conditions detected through the separately executed condition detection processing. In subsequent step S120, the ECU 6 sets a wait time Tw before actuation of the discharge switch 30 in accordance with the operation conditions read in step silo.

The wait time Tw is determined such that the ion current Iio can be detected after the voltage damped oscillation generated in the secondary-side circuit of the ignition coil 12 after spark discharge has converged sufficiently. The wait time Tw may be set through use of ROM. In this case, the experimentally obtained relationship between the operation conditions and the wait time Tw is stored in the ROM in the form of a table, and the wait time Tw is read out from the ROM while the operation conditions are used as reference values.

In subsequent step S130, a judgement is made as to whether the ignition timing at which the spark plug 10 causes spark discharge has arrived. Specifically, the arrival of the ignition timing is judged based on whether the ignition signal IG has been switched from the high level to the low level by the separately executed signal output processing. The ECU 6 repeatedly performs step S130 until the ignition timing has arrived. When the ignition timing is judged to have arrived, the ECU proceeds to step S140.

In step S140, judgement is made as to whether the wait time Tw set in step S120 has elapsed. This judgement is made on the basis of clocking time elapsed after the ignition timing, by use of a timer built into the ECU 6. If it is judged that the wait time Tw has elapsed, the ECU 6 proceeds to step S150. In step S150, the ECU 6 brings the detection signal Sd to the high level during a predetermined detection period in order to operate the discharge switch 30 during that period, to thereby short-circuit the opposite ends of the charge diode 28. The detection period is preferably set such that when the ion current Iio flows properly, the charge of the capacitor 24 is discharged completely.

In subsequent step S160, during the detection period (during which the detection signal Sd is at the high level), the ECU 6 reads in a detection value Dio from the detection circuit 8, which is obtained through analog-to-digital conversion of the voltage Vio across the resistor 20.

After completion of the detection period, in step S170, the ECU 6 outputs a ground signal Sg in order to turn on the transistor 32 to thereby discharge the charge remaining at the spark plug 10. Subsequently, the present processing is ended.

Figure 3:
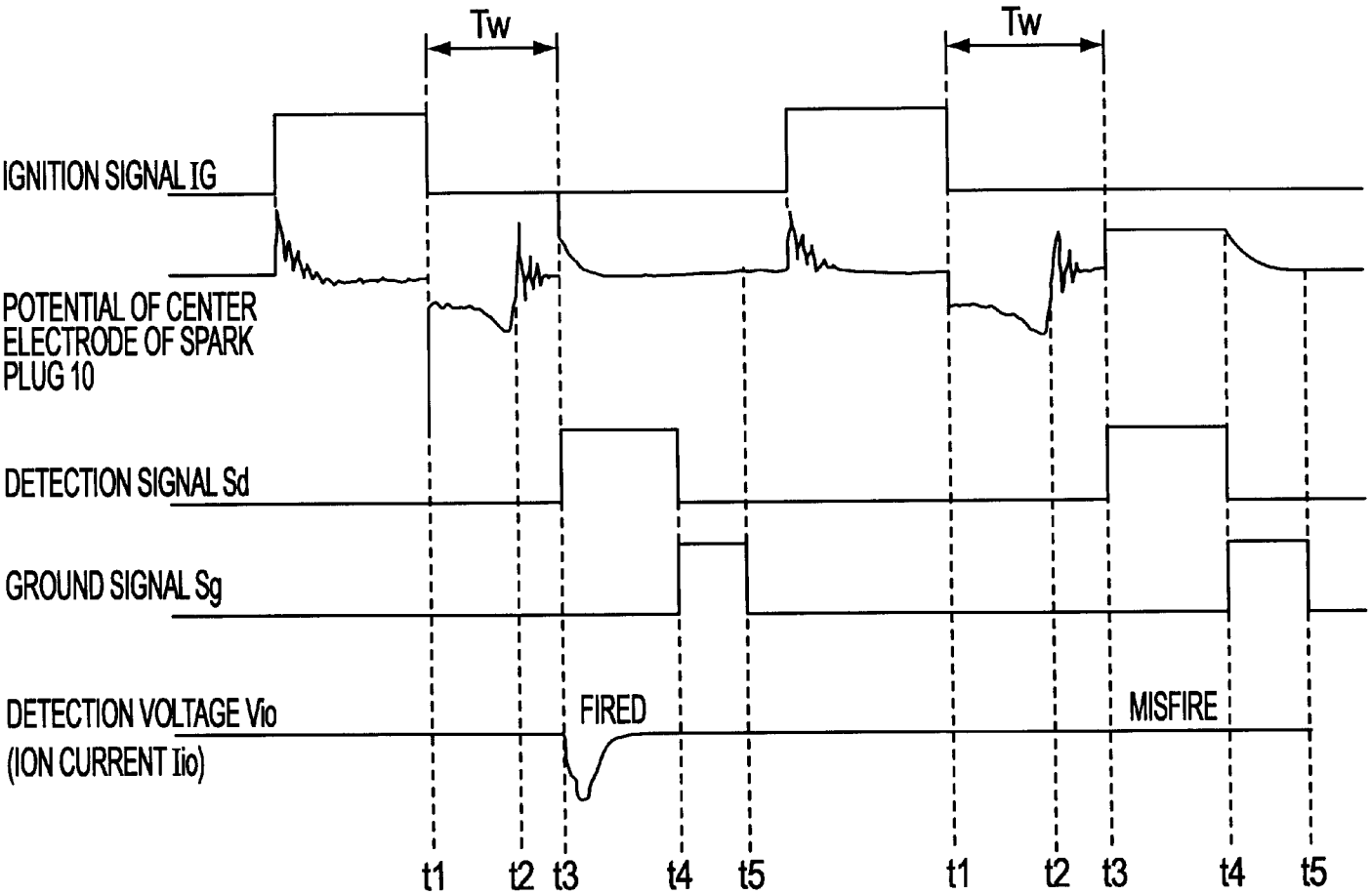
FIG. 3 is a wave chart showing signals at respective points in the apparatus of the first embodiment.

That is, in the present embodiment, when the ignition signal IG is switched from the high level to the low level yes in S130), the power transistor 14 is turned off, so that the current flowing through the primary winding L1 of the ignition coil 12 is cut off. As a result, a high ignition voltage (several tens of kilovolts) is induced in the secondary winding L2 and is applied to the center electrode of the spark plug 10, so that, as shown in FIG. 3, the spark plug 10 causes spark discharge (time t1).

The spark discharge current Isp flowing upon the spark discharge causes the Zener diode 26 to generate a Zener voltage Vz and flows into the capacitor 24 via the charge diode 28 to thereby charge the capacitor 24.

Upon completion of discharge, the high ignition voltage induced in the secondary winding L2 starts damped oscillation (time t2). However, during the wait period Tw, the detection signal Sd is maintained at the low level and thus the discharge switch 30 is maintained open. Therefore, the charge accumulated in the capacitor 24 is not discharged (time t2 to t3).

When the wait time Tw has elapsed (yes in S140) and the detection signal Sd is switched to the high level (S150), the opposite ends of the charge diode 28 are short-circuited by the discharge switch 30 during the detection period, during which the detection signal Sd is maintained at the high level. Thus, discharge from the capacitor 24 is allowed (time t3). As a result, a high detection voltage is applied to the spark plug 10 via the secondary winding L2 of the ignition coil 12, so that an ion current Iio flows in correspondence with the number of ions present between the electrodes of the spark plug 10.

At this time, the detection circuit 8 performs analog-to-digital conversion for the voltage Vio that is produced across the resistor 20 due to the ion current Io flowing therethrough, and outputs the thus-obtained detection value Dio. This detection value Dio is taken into the ECU 6 (S160).

The detection value Dio of the ion current Iio taken in to the ECU 6 is used for judgement of the generation of misfire or knocking of the engine as well as for detection of various operation conditions (e.g., air-fuel ratio, lean limit of the air-fuel ratio, and limit of amount of recirculated exhaust gas) of the engine.

Subsequently, when the detection signal Sd is switched to the low level after completion of the detection period, the discharge from the capacitor 24 is prevented by means of the charge diode 28 (time t4). Accordingly, the voltage generated at the capacitor 24 is not applied to the electrode of the spark plug 10 even when no ion current Iio flows, due to misfire or the like of the engine, and thus charge remains in the capacitor 24.

Further, at the same time, the ground signal sg is switched to the high level in order to cause the transistor 32 to ground the line of the ion current detection apparatus 4 connected to the secondary winding L2. Thus, the charge that remains at the electrodes of the spark plug 10 due to insufficient flow of the ion current Iio in the case of, for example, misfire is reliably discharged (time t4 to t5). Therefore, the spark plug 10 is not left in a state in which an undesired voltage is applied between the electrodes of the spark plug 10.

The turning-on of the transistor 32 (discharge of the remaining charge of the spark plug 10) may be performed at an arbitrary timing between the point in time when the detection signal Sd is switched to the low level and the point in time when subsequent spark discharge is caused (when the ignition signal IG is switched to the low level). Further, the transistor 32 may be disposed at any position in the current path between the anode of the charge diode 28 and the spark plug 10.

As described above, in the ion current detection apparatus 4 of the present embodiment, during only the detection period in which the ion current Iio is to be detected, discharge of charge accumulated in the capacitor 24 is allowed in order to apply a high voltage for detection to the spark plug 10.

Accordingly, in the ion current detection apparatus 4 of the present embodiment, even when voltage damped oscillation occurs in the secondary-side circuit of the ignition coil 12 after spark discharge, charge accumulated in the capacitor 24 is not wastefully consumed thereby, so that the capacitance of the capacitor 24 can be set to a necessary and sufficient value.

Further, the ion current detection apparatus 4 of the present embodiment is designed to detect the ion current Iio after passage of the wait time Tw after spark discharge of the spark plug 10. Accordingly, according to the present embodiment, the ion current Iio can be detected in a state in which the voltage damped oscillation of the secondary-side circuit has converged sufficiently. Thus, the accuracy in detecting the ion current Iio can be increased, and a filter circuit or the like for removing, from the detection value Vio (Dio) of the ion current Iio, noise components stemming from the damped oscillation can be omitted or simplified.

Further, in the ion current detection apparatus 4 of the present embodiment, since the wait time Tw before actuation of the discharge switch 30; i.e., the detection timing of the ion current Iio, is set in accordance with operation conditions, such as the rotation speed of the engine, that affect the generation of the ion current Iio, accurate detection can be always performed regardless of variations in the operation conditions.

Moreover, even when only a small amount of ion current Iio flows after spark discharge due to misfire of the engine or other cause, and charge remains at the capacitor 24 and the spark plug 10, application of an undesirable voltage to the electrode of the spark plug 10 can be reliably prevented through a simple operation of opening the discharge switch 30 and turning on the transistor 32, so that contamination of the spark plug 10 is prevented.

Second Embodiment

Next, a second embodiment of the present invention will be described.

Figure 4:
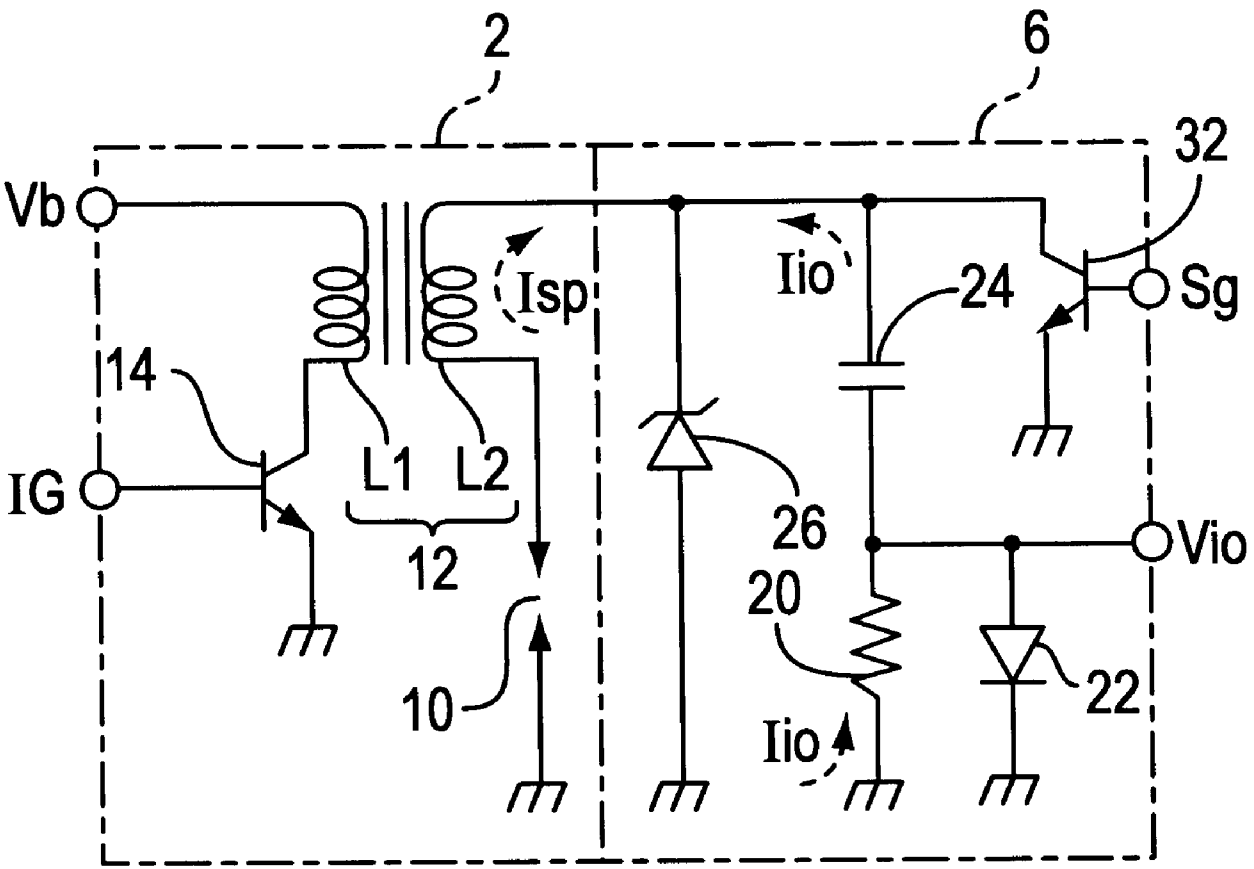
FIG. 4 is a diagram showing the overall structure of an internal combustion engine control system to which an ion current detection apparatus of a second embodiment is applied.
Figure 5:
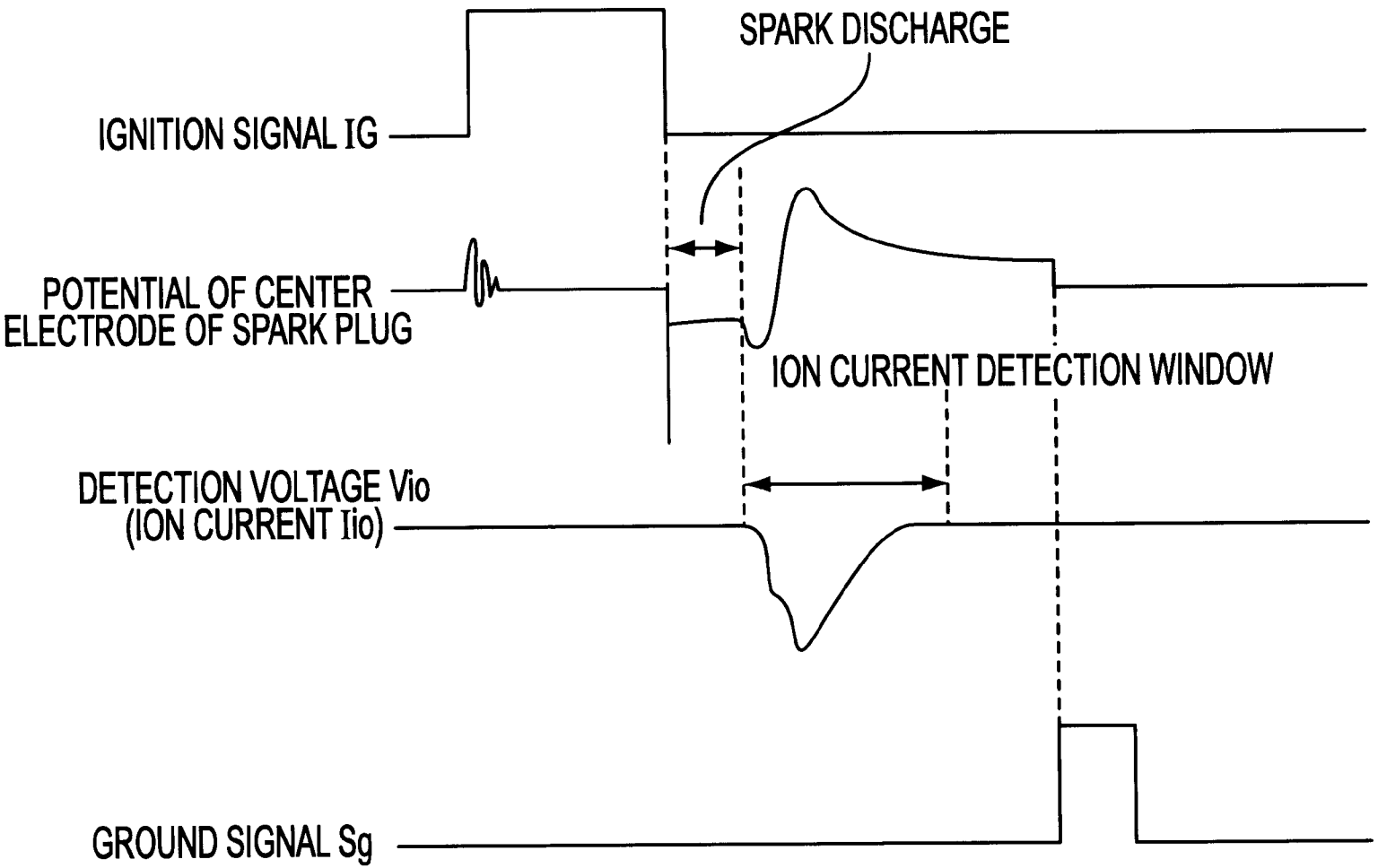
FIG. 5 is a wave chart showing signals at respective points in the apparatus of the second embodiment.

As shown in FIG. 4, an ion current detection apparatus 6 according to the present embodiment is constructed in the same manner as in the ion current detection apparatus 4 of the first embodiment, except that the charge diode 28 and the discharge switch 30 are omitted from the ion current detection apparatus 4. However, the secondary winding L2 of the ignition coil 12 is designed to have an inductance and stray capacitance such that damped voltage oscillation that is generated in the circuit on the secondary side of the ignition coil 12 after spark discharge is decreased sufficiently.

The ion current detection processing performed by the ECU 6 is the same as that performed in the first embodiment, except that the processing of step S150 related to the operation of the discharge switch 30 is omitted, and the wait time in step S140 is set such that the detection value Dio of the ion current is read in during a period between completion of spark discharge Isp and extinction of ion current Iio.

Accordingly, in the ion current detection apparatus 6 of the present embodiment, when the ignition signal IG is switched from the high level to the low level (S110–S130), a high ignition voltage (several tens of kilovolts) is induced in the secondary winding L2 of the ignition coil 12, so that the spark plug 10 causes spark discharge (time t11). Due to the spark discharge current Isp flowing during the spark discharge, the capacitor 24 is charged. The above-described operation is completely identical to that in the first embodiment.

When the discharge ends (time t12), and the high voltage for ignition induced in the secondary winding L2 becomes lower than the Zener voltage Vz, due to discharge of the capacitor 24, a high detection voltage corresponding to the charged voltage Vc of the capacitor 24 is applied to the spark plug 10 via the secondary winding L2 of the ignition coil 12, so that an ion current Iio flows in correspondence with the number of ions present between the electrodes of the spark plug 10.

At this time, the detection circuit 8 performs analog-to-digital conversion for the voltage Vio that is produced across the resistor 20 due to the ion current Iio flowing therethrough, and outputs the thus-obtained detection value Dio. This detection value Dio is taken into the ECU 6 (S140, S160).

When the ions between the electrodes of the spark plug 10 disappear and the ion current Iio becomes zero (time t13), the voltage across the capacitor 24 is held at a level corresponding the residual charge at that time, so that the voltage across the capacitor 24 is applied to the spark plug 10. Especially, when the ion current Iio does not flow in a sufficient amount due to misfire or the like, the applied voltage becomes considerably high.

However, when the ground signal Sg is switched to the high level to turn on the transistor 32 (time t14), the charge that remains in the capacitor 24 is discharged. Therefore, the spark plug 10 is not left in a state in which an undesired voltage is applied between the electrodes of the spark plug 10.

The turning-on of the transistor 32 (discharge of the remaining charge of the spark plug 10) through use of the ground signal Sg may be performed at arbitrary timing between the point in time when the ECU 6 reads in the detection value Dio and the point in time when subsequent spark discharge is caused. However, the transistor 32 is preferably turned on as early as possible. Further, the transistor 32 may be disposed at any position in the current path between the capacitor 24 and the spark plug 10.

As described above, in the ion current detection apparatus 6 of the second embodiment, after detection of the ion current Iio, the transistor 32 is turned on in order to discharge the residual charges of the capacitor 24 and the spark plug 10. Therefore, it is possible to prevent application of an undesirable voltage to the electrode of the spark plug 10, which would otherwise occur before subsequent spark discharge, so that contamination of the spark plug 10 is prevented.

While the invention has been described in detail and with reference to specific embodiments thereof, it will be apparent to one skilled in the art that various changes and modifications can be made therein without departing from the spirit and scope thereof.

What is claimed is:

1. An ion current detection apparatus comprising:

a capacitor which forms a closed loop together with a spark plug and a secondary winding of an ignition coil;

current detection means for detecting current flowing through said closed loop; and charge means for charging said capacitor to a predetermined high voltage for detection, through use of spark discharge current flowing during spark discharge of the spark plug, wherein a high voltage for ignition which is generated in the secondary winding through intermittent supply of primary current to a primary winding of said ignition coil is applied to the spark plug attached to a cylinder of an internal combustion engine in order to cause spark discharge; subsequently, said capacitor charged by said charge means applies to the secondary winding of said ignition coil and the spark plug a high voltage for detection having a polarity opposite that of the high voltage for ignition; and an ion current flowing through said closed loop at this time is detected by said current detection means, and wherein said ion current detection apparatus further comprises:

a charge diode which is connected in series to said capacitor and secondary winding such that the forward direction of said charge diode coincides with the flow direction of the spark discharge current and is adapted to prevent discharge of charge accumulated in said capacitor by said charge means;

a discharge switch which short-circuits opposite ends of said charge diode in order to discharge charge accumulated in said capacitor; and a switching control means which operates said discharge switch at a timing at which the ion current is to be detected.

2. An ion current detection apparatus according to claim 1, wherein the timing at which said switching control means operates said discharge switch is set in accordance with the operation conditions of the engine.

3. An ion current detection apparatus according to claim 1, wherein grounding means is provided in order to ground a current path extending from the anode of said charge capacitor to the spark plug during an arbitrary period after said discharge switch is opened but before the next spark discharge is caused.

4. An ion current detection apparatus according to claim 2, wherein grounding means is provided in order to ground a current path extending from the anode of said charge capacitor to the spark plug during an arbitrary period after said discharge switch is opened but before the next spark discharge is caused.

5. An ion current detection apparatus comprising:

a capacitor which forms a closed loop together with a spark plug and a secondary winding of an ignition coil;

current detection means for detecting current flowing through said closed loop; and charge means for charging said capacitor to a predetermined high voltage for detection, through use of spark discharge current flowing during spark discharge of the spark plug, wherein a high voltage for ignition which is generated in the secondary winding through intermittent supply of primary current to a primary winding of said ignition coil is applied to the spark plug attached to a cylinder of an internal combustion engine in order to cause spark discharge; subsequently, said capacitor charged by said charge means applies to the secondary winding of said ignition coil and the spark plug a high voltage for detection having a polarity opposite that of the high voltage for ignition; and an ion current flowing through said closed loop at this time is detected by said current detection means, and wherein said ion current detection apparatus further comprises:

grounding means for grounding a high voltage side of said capacitor charged by said charge means, during an arbitrary period between detection of the ion current by said current detection means and subsequent spark discharge.

* * * * *